US008676065B2

(12) United States Patent
Park et al.

(10) Patent No.: US 8,676,065 B2
(45) Date of Patent: Mar. 18, 2014

(54) METHOD FOR PROCESSING PAPER JAM IN IMAGE FORMING APPARATUS HAVING AT LEAST ONE OPTION CASSETTE, AND IMAGE FORMING APPARATUS THAT PERFORMS THE METHOD

(75) Inventors: Sang-gyu Park, Seoul (KR); Yun-su Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 456 days.

(21) Appl. No.: 12/471,794

(22) Filed: May 26, 2009

(65) Prior Publication Data

US 2010/0080575 A1 Apr. 1, 2010

(30) Foreign Application Priority Data

Sep. 29, 2008 (KR) ..... 10-2008-0095543

(51) Int. Cl.
*G03G 15/00* (2006.01)
*B65H 7/02* (2006.01)

(52) U.S. Cl.
USPC ..... 399/21; 399/20; 399/23; 399/22; 399/124; 399/388; 271/9.01; 271/258.01

(58) Field of Classification Search
USPC ..... 399/21, 391, 20, 23, 22, 124, 114, 388; 271/9.01, 256, 258.01; 400/691, 692, 400/693
See application file for complete search history.

(56) References Cited

U.S. PATENT DOCUMENTS

| | | | | |
|---|---|---|---|---|
| 5,461,460 | A * | 10/1995 | Lee | 399/21 |
| 5,602,625 | A * | 2/1997 | Okamoto et al. | 399/21 |
| 5,815,765 | A * | 9/1998 | Park | 399/18 |
| 6,757,501 | B2 * | 6/2004 | Mochizuki et al. | 399/18 |
| 2002/0071684 | A1 * | 6/2002 | Hirako et al. | 399/18 |
| 2004/0169899 | A1 * | 9/2004 | Wada | 358/498 |
| 2006/0233558 | A1 * | 10/2006 | Son | 399/18 |

* cited by examiner

*Primary Examiner* — Matthew G Marini
(74) *Attorney, Agent, or Firm* — Staas & Halsey LLP

(57) ABSTRACT

An image forming apparatus including at least one option cassette, and a paper jam handling method performed in the image forming apparatus are provided. The paper jam handling method includes the operations of detecting whether paper jam occurs in the image forming apparatus, checking whether paper sheets exist on a transfer path of the image forming apparatus and on a transfer path of the option cassette, when the paper jam is detected, and leaving the paper sheet on the transfer path of the option cassette as it is and discharging the paper sheet caught on the transfer path of the image forming apparatus. Accordingly, paper damage or paper consumption may be prevented by not discharging a paper sheet caught on a transfer path of at least one option cassette during paper jam.

8 Claims, 8 Drawing Sheets

METHOD FOR PROCESSING PAPER JAM IN IMAGE FORMING APPARATUS HAVING AT LEAST ONE OPTION CASSETTE, AND IMAGE FORMING APPARATUS THAT PERFORMS THE METHOD

CROSS-REFERENCE TO RELATED PATENT APPLICATION

This application claims the benefit of Korean Patent Application No. 2008-95543, filed in the Korean Intellectual Property Office on Sep. 29, 2008, the disclosure of which is incorporated herein in its entirety by reference.

BACKGROUND OF THE INVENTION

1. Field of the Invention

Aspects of the present general inventive concept relate to handling of paper jams in an image forming apparatus, and more particularly, to a method and apparatus for handling paper jams in an image forming apparatus including at least one option cassette, whereby paper sheets on an option cassette transfer path can be used when paper jams occur in the image forming apparatus.

2. Description of the Related Art

In general, in image forming systems including at least one option cassette, when a paper jam occurs when a sheet of paper is being fed from a lower option cassette and an image is being printed on the paper sheet, a motor of the image forming apparatus and a motor of the option cassette are both stopped. When a system for automatically discharging jammed paper opens and then closes a cover of the image forming apparatus, a paper sheet in the image forming apparatus and a paper sheet on a transfer path in the option cassette are both discharged.

FIG. 1 illustrates a conventional process of discharging paper sheets existing within an image forming apparatus and an option cassette transfer path when a paper jam occurs. In FIG. 1, (a) illustrates a case where one sheet of paper is jammed in the image forming apparatus and two sheets of paper exist on the option cassette transfer path, (b) illustrates a process of discharging the paper sheet existing in the image forming apparatus and the paper sheets on the option cassette transfer path after the paper jam occurs and a cover of the image forming apparatus is opened and closed, and (c) illustrates a conventional image forming system in a state after the paper sheet jammed in the image forming apparatus and the paper sheets on the option cassette transfer path are completely discharged.

If paper sheets existing in an option cassette transfer path are automatically discharged through the image forming apparatus although they can still be used, the paper sheets may be damaged. In addition, since a new paper sheet needs to be picked up from an option cassette having paper sheets in order to perform printing, a paper jam recovery time lengthens. If a motor of each option cassette is stopped simultaneously when a motor of the image forming apparatus is stopped due to paper jam, paper curl in which paper sheets existing in an option cassette transfer path are not completely spread out and slightly shrunk and curled may be generated. FIG. 2 illustrates generation of paper curl when motors of a plurality of option cassettes are stopped simultaneously due to a paper jam.

SUMMARY OF THE INVENTION

Aspects of the present general inventive concept provide a method of handling paper jam in an image forming apparatus including at least one option cassette, wherein paper sheets caught on a transfer path can be used when paper jam in the image forming apparatus is handled.

Aspects of the present general inventive concept also provide an image forming apparatus using the above-described method of handling paper jam.

According to an aspect of the present general inventive concept, a paper jam handling method performed in an image forming apparatus including at least one option cassette is provided. The method includes detecting whether a paper jam occurs in the image forming apparatus; checking whether paper sheets exist on a transfer path of the image forming apparatus and on a transfer path of the option cassette, when the paper jam is detected; and leaving the paper sheet on the transfer path of the option cassette as it is and discharging the paper sheet caught on the transfer path of the image forming apparatus.

According to another aspect of the present general inventive concept, an image forming apparatus including at least one option cassette is provided. The image forming apparatus includes an image forming apparatus paper jam sensor unit to senses whether a paper jam occurs in the image forming apparatus; an option cassette paper jam sensor unit to sense whether the paper jam occurred in the at least one option cassette; a motor unit to stop driving the image forming apparatus and the at least one option cassette, when the paper jam is detected by the image forming apparatus paper jam sensor unit; and a control unit to leave a paper sheet on a transfer path of the at least one option cassette as is and discharges only a paper sheet caught within the image forming apparatus, when the paper jam is detected and then a cover of the image forming apparatus is opened and then closed.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
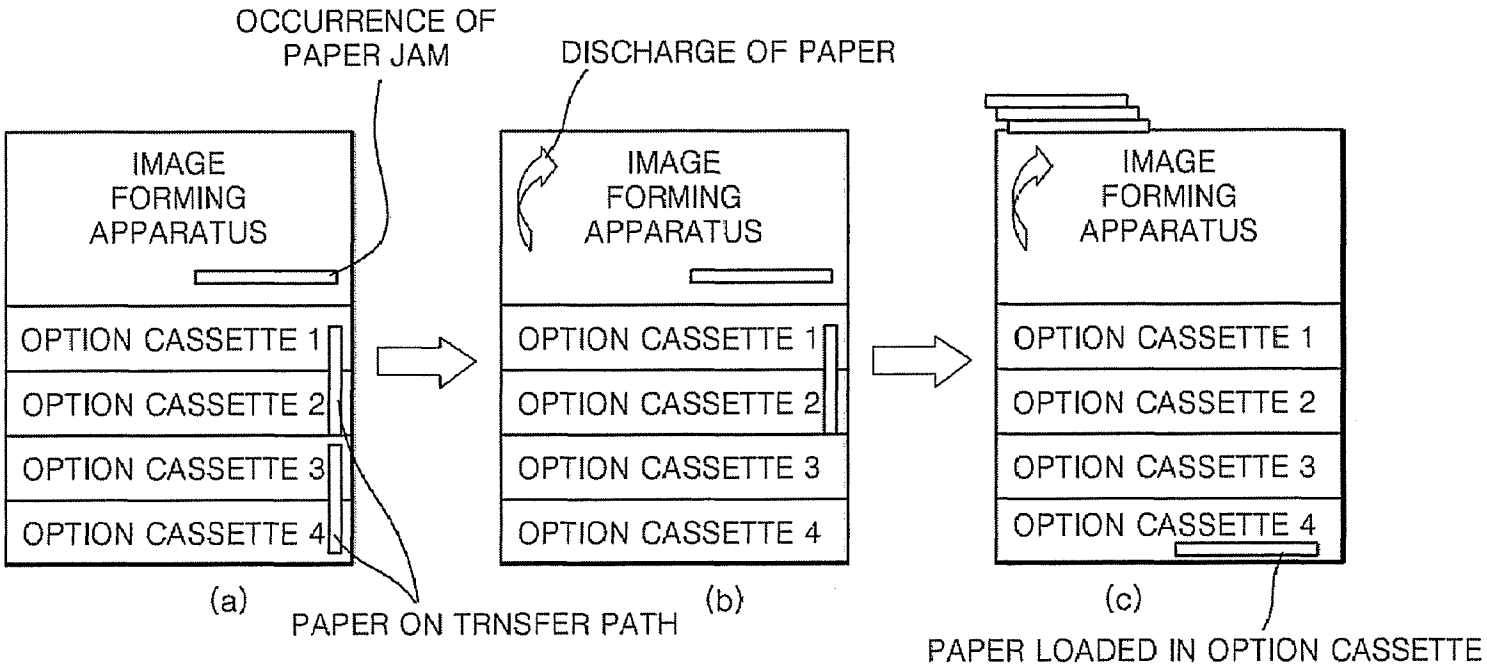
FIG. 1 illustrates a conventional process of discharging a paper sheet in an image forming apparatus and paper sheets on an option cassette transfer path when a paper jam occurs.
Figure 2:
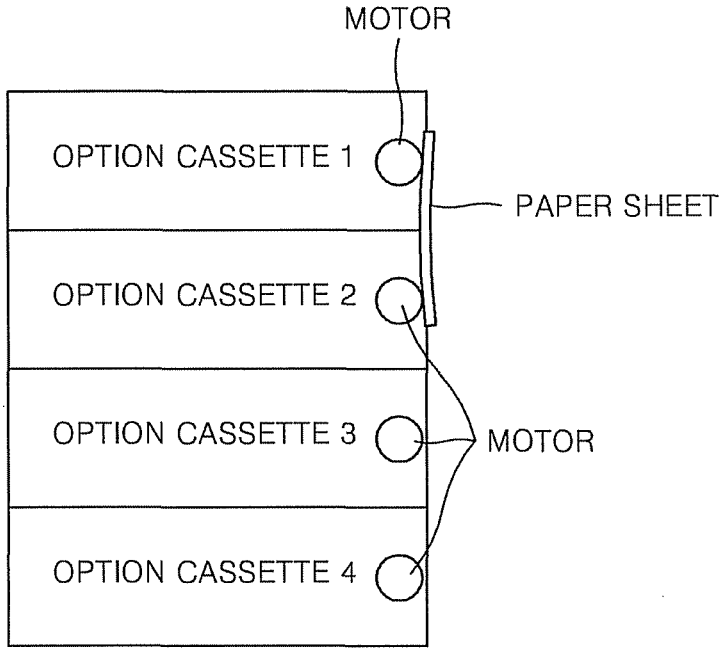
FIG. 2 illustrates generation of paper curl when motors of a plurality of option cassettes are stopped simultaneously due to a paper jam.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
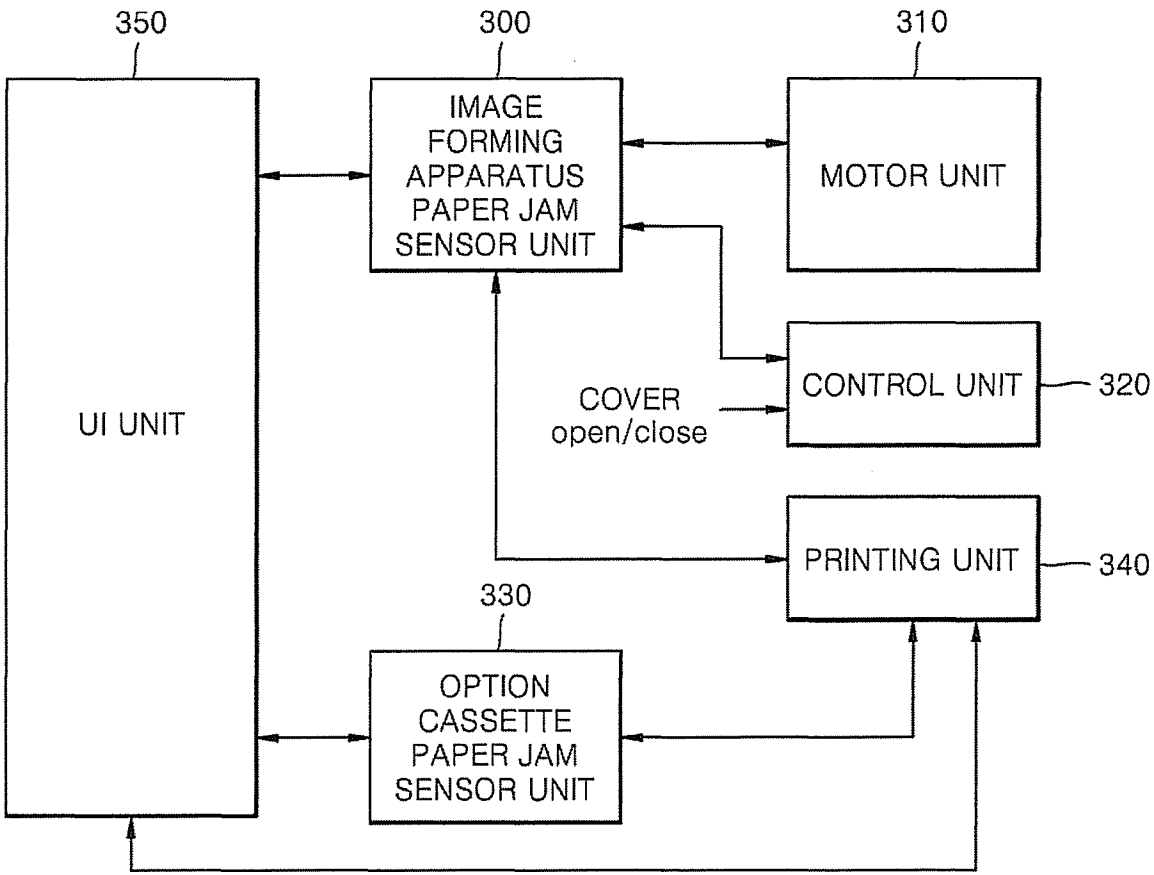
FIG. 3 is a block diagram of a structure of an image forming apparatus including at least one option cassette, according to an embodiment of the present general inventive concept.

FIG. 3 is a block diagram of a structure of an image forming apparatus that reuses sheets of paper existing on an option cassette transfer path during paper jam, according to an embodiment of the present general inventive concept. The image forming apparatus includes an image forming apparatus paper jam sensor unit 300, a motor unit 310, a control unit 320, and an option cassette paper jam sensor unit 330. The image forming apparatus may further include a printing unit 340 and a user interface (UI) unit 350. The image forming apparatus may include additional units. Similarly, the functionality of two or more of the above units may be integrated into a single component. Although described herein with respect to paper, any printable medium may be employed in the image forming apparatus. Thus, a paper sheet should be interpreted as referring to any type of printable medium that can be loaded into an image forming apparatus.

The image forming apparatus paper jam sensor unit 300 senses paper jams occurring in the image forming apparatus. The image forming apparatus paper jam sensor unit 300 may include a feed sensor (not shown) which senses the feeding of paper, and an exit sensor which senses the discharge of paper.

The motor unit 310 drives the image forming apparatus and at least one option cassette. When the image forming apparatus paper jam sensor unit 300 senses a paper jam, the motor unit 310 stops driving the image forming apparatus and the option cassettes. When a paper jam occurs, the motor unit 310 may first stop a lower option cassette from among the option cassettes and then stop an upper option cassette after a certain period of time. When printing resumes starting from the paper sheets on the option cassette transfer path, the motor unit 310 may first drive the upper option cassette and then drive the lower option cassette after a certain period of time lapses. Thus, paper curl may be prevented.

When a paper jam is sensed by the image forming apparatus paper jam sensor unit 300 and the cover of the image forming apparatus is opened and then closed to recover the original state, the control unit 320 discharges only a paper sheet jammed in the image forming apparatus. Paper sheets on the option cassette transfer path are left as they are. The jammed paper sheet may be automatically discharged by a motor or manually discharged by a user.

In duplex apparatuses or high-end products, at least two paper sheets may be jammed on a transfer path in the image forming apparatus. In this case, the cover of the image forming apparatus may be opened and the jammed paper sheets manually removed by a user. Alternatively, the jammed paper sheets may be automatically discharged by a motor when the cover is opened and then closed. In some cases, the jammed paper sheets may be discharged by sequentially performing the two above-described methods.

The control unit 320 discharges paper sheets caught on rollers of the image forming apparatus and even a paper sheet caught between rollers of the image forming apparatus closest to an option cassette, and thus may secure a distance between a paper sheet next to the discharged paper sheet and the feed sensor so as to secure a period of time during which image formation can be performed.

The option cassette paper jam sensor unit 330 senses paper jams occurring in the option cassette. Typically, the option cassette paper jam sensor unit 330 includes paper jam sensors respectively attached to inner surfaces of option cassettes.

The printing unit 340 checks the image forming apparatus paper jam sensor unit 300 and the option cassette paper jam sensor unit 330. If no paper sheets are jammed in the image forming apparatus and a paper sheet exists on the option cassette transfer path, the printing unit 340 starts printing on the paper sheet on the option cassette transfer path. The printing unit 340 compares the turned-off periods of the paper jam sensors for the option cassettes with one another in order to check that no paper sheets exist on the option cassette transfer path, picks up a paper sheet from an option cassette having paper sheets and is closest to the option cassette transfer path, and performs printing on the picked-up paper sheet.

The UI unit 350 may provide to users a menu for selecting either a removal of both the paper sheets jammed in the image forming apparatus and in the option cassette transfer path or a removal of only the paper sheet jammed in the image forming apparatus. A first paper jam handling mode for handling paper jams on a transfer path in the image forming apparatus and a second paper jam handling mode for handling paper jams on an option cassette transfer path are provided to users through the UI unit 350, and the users may select one or both of the first and second paper jam handling modes.

After the paper sheet jammed in the image forming apparatus is removed, the UI unit 350 may display paper sheets on the option cassette transfer path as they are, and indicate that the paper sheet jammed in the image forming apparatus has been removed. In addition, the UI unit 350 may indicate that the paper sheets on the option cassette transfer path are first output and then a sheet of paper on which an image is to be printed is picked up from an option cassette after all of the paper sheets existing on the option cassette transfer path are used.

Figure 4:
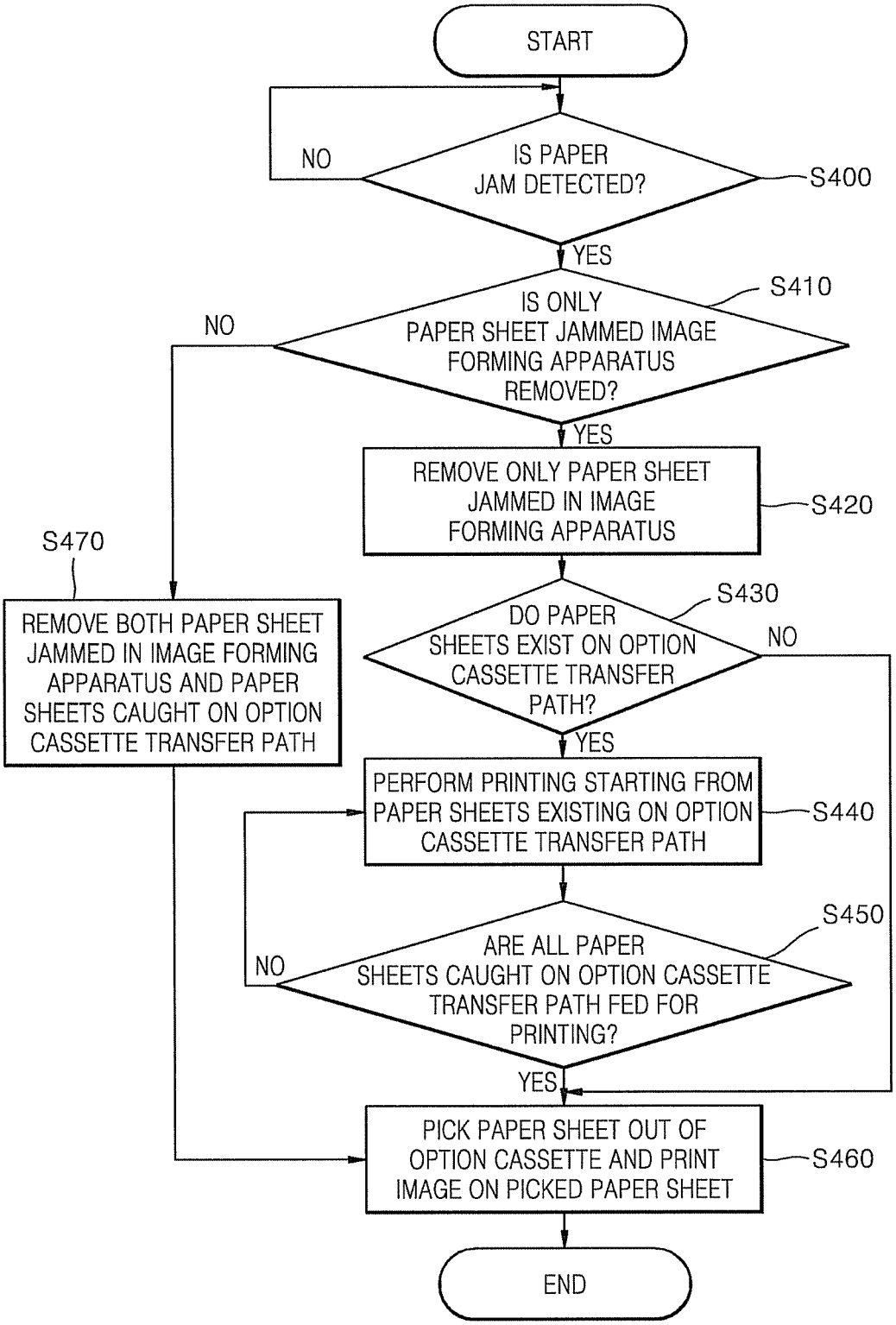
FIG. 4 is a flowchart of a paper jam handling process performed in the image forming apparatus illustrated in FIG. 3, according to an embodiment of the present general inventive concept.

FIG. 4 is a flowchart of a paper jam handling process performed in the image forming apparatus of FIG. 3, according to an embodiment of the present general inventive concept. When a paper jam is detected by the image forming apparatus paper jam sensor unit 300 in operation S400, whether both the paper sheets jammed in the image forming apparatus and on the option cassette transfer path are removed or only the paper sheet jammed in the image forming apparatus is removed is selected by the UI in operation S410.

Figure 5:
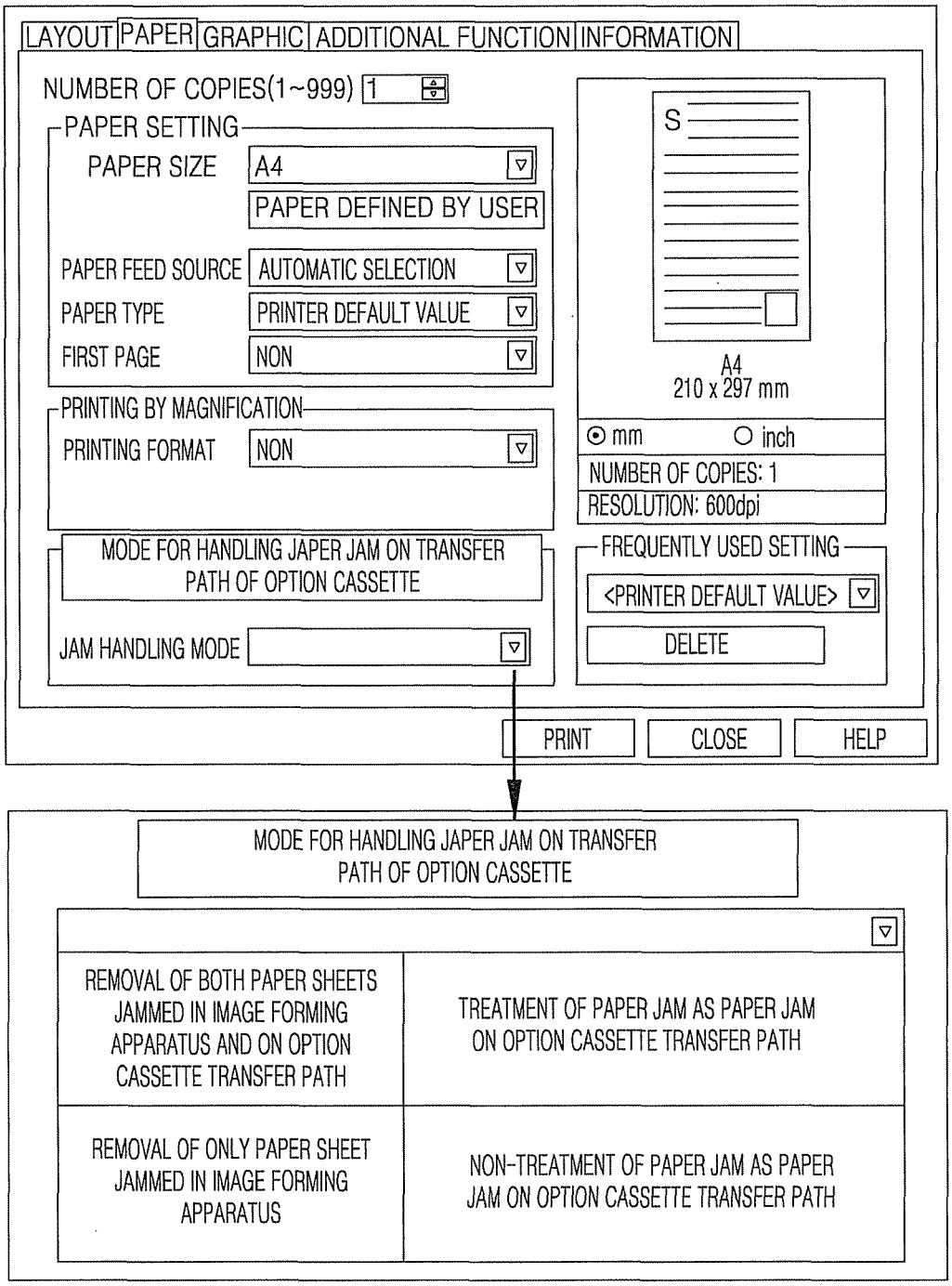
FIG. 5 illustrates a user interface (UI) screen for selection of a handling mode.

FIG. 5 illustrates a UI screen for the selection performed in operation S410. If the removal of both the paper sheets jammed in the image forming apparatus and on the option cassette transfer path is selected, the paper jam may be treated as a paper jam on the option cassette transfer path, and the treatment as the paper jam on the option cassette transfer path may be displayed through the UI unit 350. On the other hand, if the removal of only the paper sheet jammed in the image forming apparatus is selected, the paper jam may not be treated as paper jam on the option cassette transfer path, and the non-treatment as paper jam on the option cassette transfer path may be displayed through the UI unit 350. A first paper jam handling mode for handling paper jams on the transfer path within the image forming apparatus and a second paper jam handling mode for handling paper jams on the option cassette transfer path may be provided to users through a UI, and the users may select one or both of the first and second paper jam handling modes. The UI may be provided through a UI of the image forming apparatus or through a UI of a host connected to the image forming apparatus. In some cases, the UI may be provided through both the UI of the image forming apparatus and the UI of the host connected to the image forming apparatus.

Referring back to FIG. 4, if the removal of both the paper sheets jammed in the image forming apparatus and on the option cassette transfer path is selected in operation S410, both the paper sheet jammed in the image forming apparatus and the paper sheets caught on the option cassette transfer path are removed in operation S470. If the removal of only the paper sheets jammed in the image forming apparatus is selected in operation S410, the paper sheets caught on the option cassette transfer path are left as they are, and only the paper sheet jammed in the image forming apparatus is discharged by opening and closing the cover of the image forming apparatus in operation S420.

In duplex apparatuses or high-end products, at least two paper sheets may be jammed on the transfer path within the image forming apparatus. In this case, the cover of the image forming apparatus may be opened and then the jammed paper sheets may be manually removed by a user. Alternatively, the jammed paper sheets may be automatically discharged by a motor when the cover is opened and then closed. In some cases, the jammed paper sheets may be discharged by sequentially performing the two above-described methods. The UI unit may indicate a situation where the paper jam generated in the image forming apparatus has been solved and existence of paper sheets on the option cassette transfer paths.

In operation S430, after the paper sheet jammed in the image forming apparatus is discharged, the option cassette paper jam sensor unit 330 checks whether paper sheets exist on the option cassette transfer path. The checking operation S430 may be performed in advance when a paper jam has occurred. The checking order may be different but within the scope of the present general inventive concept. In operation S440, paper sheets exist on the option cassette transfer path, printing is performed starting from the paper sheets existing on the option cassette transfer path.

Figure 6:
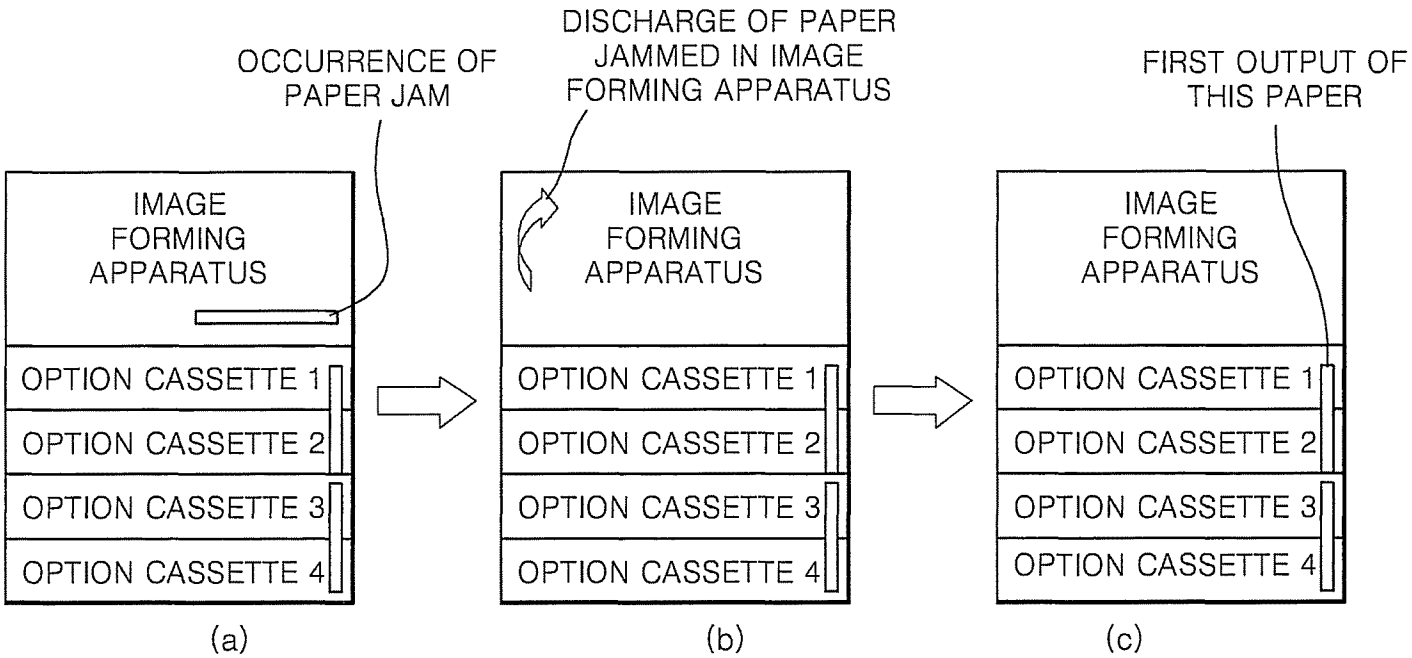
FIG. 6 illustrates a process of solving only a paper jam that occurs in an image forming apparatus.

FIG. 6 illustrates a process of discharging only a paper sheet jammed in an image forming apparatus as described above. In FIG. 6, (a) illustrates a paper jam generated in the image forming apparatus, (b) illustrates discharge of the paper sheet jammed in the image forming apparatus after a cover of the image forming apparatus is opened and then closed, and (c) illustrates a situation where printing is performed starting from paper sheets caught on an option cassette transfer path.

As described above, when a paper jam has occurred within the image forming apparatus, a motor used to pick up paper sheets from an option cassette does not operate, and only a motor for the image forming apparatus is driven, thereby discharging the paper sheet jammed in the image forming apparatus. The jammed paper sheet may be manually removed through the opened cover of the image forming apparatus. Alternatively, the jammed paper sheet may be automatically removed by the motor for the image forming apparatus when the cover is opened and then closed. In some cases, the jammed paper sheet may be discharged by sequentially performing the two above-described methods.

The paper sheets caught on the option cassette transfer path are treated as paper sheets loaded in option cassettes and thus are not discharged. If the option cassette paper jam sensor unit 330 indicates that paper sheets exist on the option cassette transfer path, printing is performed starting from the paper sheets caught on the option cassette transfer path. Even a paper sheet caught on a roller of the image forming apparatus may be discharged to secure a distance between a paper sheet next to the paper sheet caught on the roller and the feed sensor of the image forming apparatus paper jam sensor unit 300, thereby securing a period of time required for image formation.

Typically, an image is printed out when the feed sensor is turned on. Thus, since a sufficient distance between an option cassette transfer path and the feed sensor is secured due to the discharge of the paper sheet caught on the roller of the image forming apparatus, an image may be recovered without problems.

A situation where the paper sheet jammed in the image forming apparatus has been removed while paper sheets exist on the option cassette transfer path is displayed through a UI, as well as an indication that printing is being performed starting from the papers existing on the option cassette transfer path.

Figure 7:
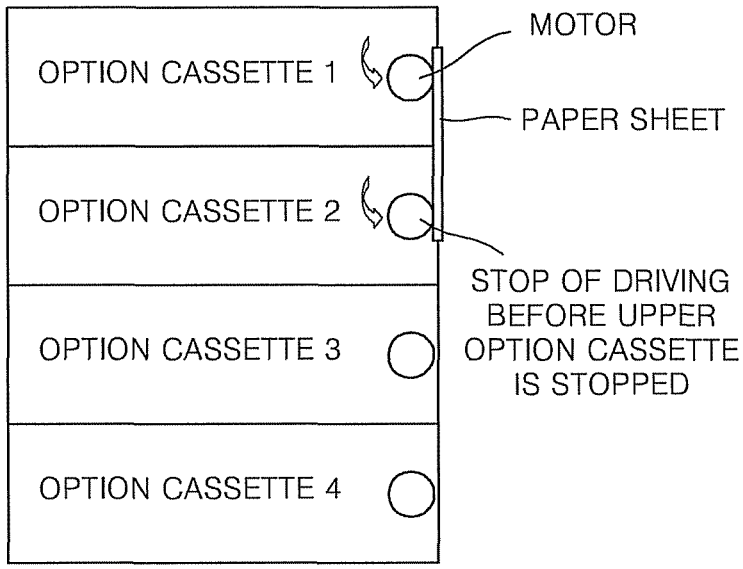
FIG. 7 illustrates a case where motors of a plurality of option cassettes are stopped at regular intervals when paper jam has occurred.
Figure 8:
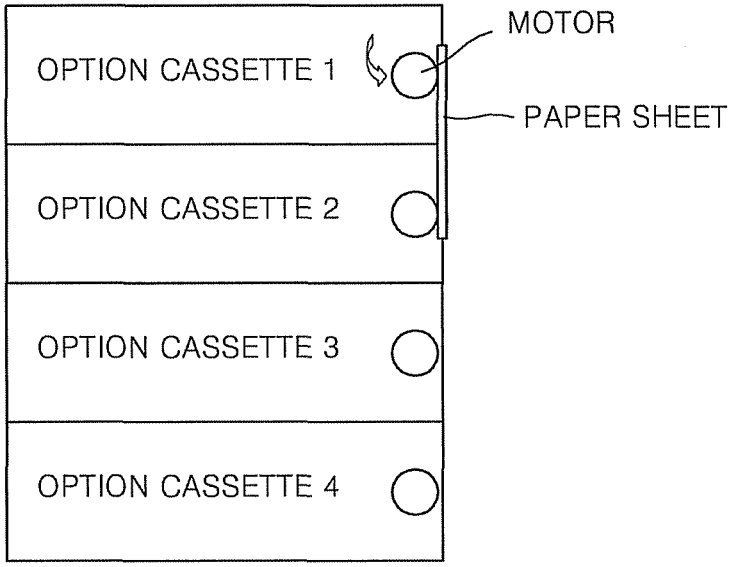
FIG. 8 illustrates a sequence in which the motors of FIG. 7 are driven when the paper jam is removed and printing resumes.

FIG. 7 illustrates a case where motors of a plurality of option cassettes are stopped at regular intervals when a paper jam has occurred. Since a paper existing on an option cassette transfer path between option cassettes 1 and 2 may be curled, a motor for a lower option cassette, namely, the option cassette 2, is stopped and then a motor for an upper option cassette, namely, the option cassette 1, is stopped after several tens of milliseconds (msec). FIG. 8 illustrates a sequence in which the motors of FIG. 7 are driven when the paper jam is solved and then printing resumes. Referring to FIG. 8, a paper sheet is uncurled by first driving the motor for the upper option cassette, and then is raised by driving the motor for the lower option cassette. By first driving the motor for the upper option cassette and then driving the motor for the lower option cassette after several tens of milliseconds, a curled paper sheet is uncurled and then used in printing.

Referring back to FIG. 4, in operation S440, printing starts on the paper sheets on the option cassette transfer path. Whether the paper sheets caught on the option cassette transfer path are all fed for printing and no paper sheets exist on the option cassette transfer path is checked in operation S450. If no paper sheets exist on the option cassette transfer path, a paper sheet is picked out of the option cassettes, and an image is printed on the picked paper sheet in operation S460.

Operations S450 and S460 will now be described in greater detail. First, the check as to whether no paper sheets exist on the option cassette transfer paths may include the following operations. Since a paper jam has occurred, an existing option cassette, an existing paper size, and an existing paper type used until the paper jam occurred are known. After paper sheets from paper sheets caught between rollers of an image forming apparatus to a paper sheet caught between rollers of the image forming apparatus which are close to the option cassette are discharged, printing starts. If the periods of time during which paper jam sensors of option cassettes 1, 2, 3, and 4 are consecutively turned off are under Conditions 1, 2, and 3, when the paper jam sensors of option cassettes 1, 2, 3, and 4 are turned on, an off timer is cleared:

[Condition 1]

Turned-off period of paper jam sensor of option cassette 4>Turned-off period of paper jam sensor of option cassette 3

[Condition 2]

Turned-off period of paper jam sensor of option cassette 3>Turned-off period of paper jam sensor of option cassette 2

[Condition 3]

Turned-off period of paper jam sensor of option cassette 2>Turned-off period of paper jam sensor of option cassette 1

Figure 9:
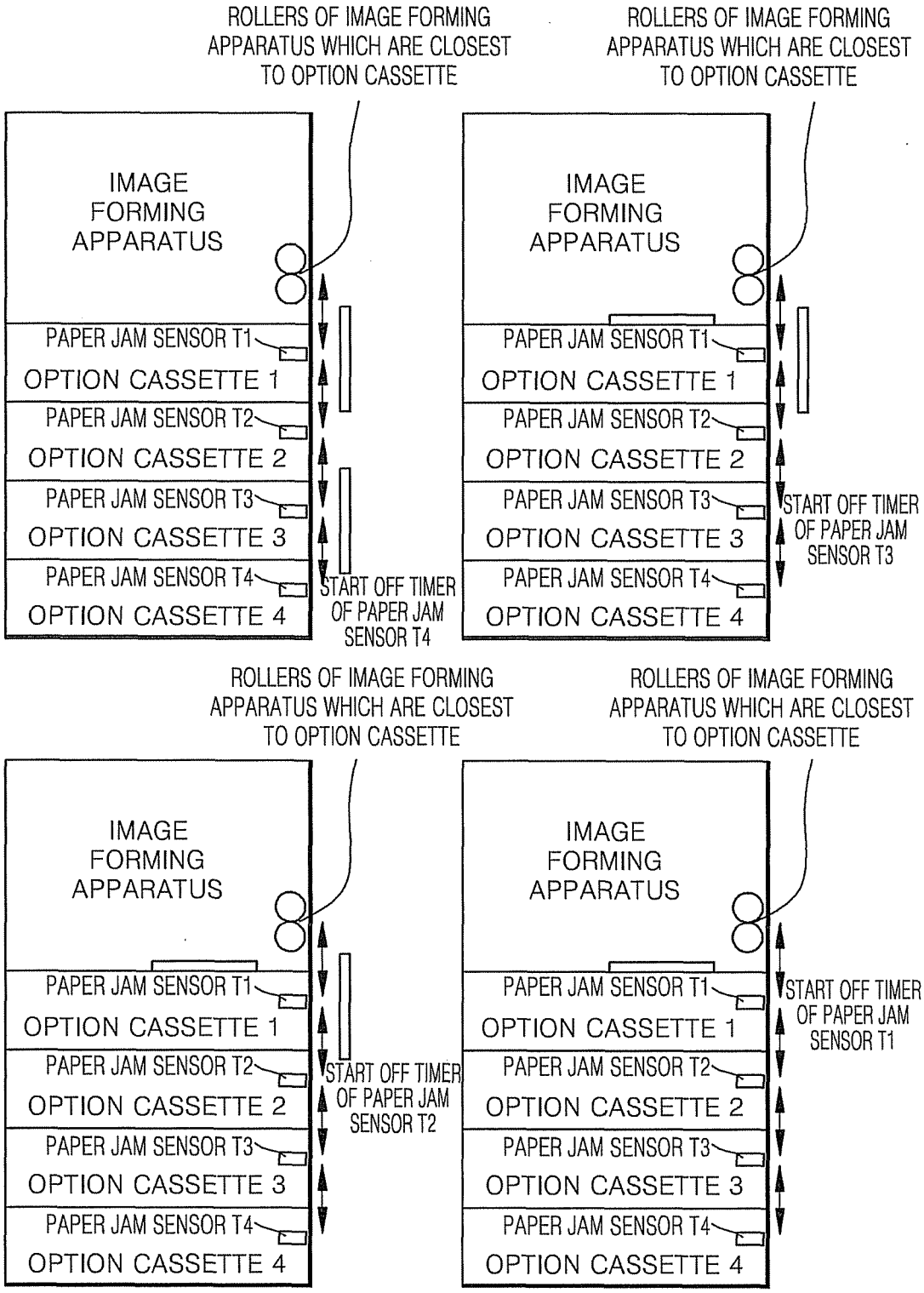
FIG. 9 illustrates a process of checking paper sheets on an option cassette transfer path by checking turned-off time periods of paper jam sensors of option cassettes.

FIG. 9 illustrates a process of checking paper sheets on an option cassette transfer path by checking the turned-off time periods of the paper jam sensors of the option cassettes 1, 2, 3, and 4. If a paper sheet being output from option cassette 4 is jammed, a paper sheet is picked up from an option cassette when Conditions 1, 2, and 3 are sequentially satisfied. If a paper sheet being output from option cassette 3 is jammed, a paper sheet is picked up from an option cassette when Conditions 2 and 3 are sequentially satisfied. If a paper sheet being output from option cassette 2 is jammed, only when Condition 3 is satisfied, a paper sheet is picked up from an option cassette. Then, a paper sheet starts being picked out of the closest option cassette suitable for conditions (for example, a paper size, a paper thickness, a paper type, etc.).

In the embodiment of the present general inventive concept, paper damage or paper consumption may be prevented by not discharging a paper sheet caught on a transfer path of at least one option cassette during paper jam. In addition, by not raising the paper sheet caught on the transfer path of the option cassette to a height of an image forming apparatus, a First Printing Output Time (FPOT) may not be long, and a recovery time may be shortened.

As described above, the present general inventive concept is applicable to laser beam printers (LBP) (including mono LBP and color LBP) and inkjet printers, and also to image forming apparatuses that support at least one cassette. The inkjet printers may use a shuttle method or an array-head method that has a head assembly which is larger than the width of paper.

Aspects of the invention can also be embodied as computer readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, hard disks, floppy disks, flash memory, optical data storage devices, and so on.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus including a plurality of option cassettes, the image forming apparatus comprising:

an image forming apparatus paper jam sensor unit to sense whether a paper jam occurs in the image forming apparatus;

an option cassette paper jam sensor unit to sense whether the paper jam occurred in the at least one option cassette;

a motor unit to stop driving the image forming apparatus and the plurality of option cassettes, when the paper jam is detected by the image forming apparatus paper jam sensor unit; and a control unit to leave a paper sheet on a transfer path of the plurality of option cassettes as is and to remove only a paper sheet jammed within the image forming apparatus, after the paper jam is detected by the image forming apparatus paper jam sensor unit; and a printing unit to resume printing starting from the paper sheet on the transfer path of the plurality of option cassettes if the paper sheet on the transfer path of the plurality of option cassettes is sensed by the option cassette paper jam sensor unit after the paper sheet jammed in the image forming apparatus is removed;

wherein the control unit operates a motor to drive the image forming apparatus to remove the paper sheet jammed within the image forming apparatus while a motor to feed paper from the option cassettes is not operational after a door for the image forming apparatus has been opened and closed;

wherein when the paper sheet jammed in the image forming apparatus is detected by the image forming apparatus paper jam sensor unit, only the paper sheet jammed in the image forming apparatus is removed by the motor unit, and the paper sheet on the transfer path of the plurality of option cassettes is used for printing by the printing unit, not to be removed.

2. The image forming apparatus of claim 1, wherein:

the printing unit compares turned-off time periods of paper jam sensors of the plurality of option cassettes with one another to check whether no paper sheets exist on transfer paths of the plurality of option cassettes, picks up a paper sheet from an option cassette that is closest to the image forming apparatus and has paper sheets if no paper sheets exist on the transfer paths of the plurality of option cassettes, and performs printing on the picked-up paper sheet.

3. The image forming apparatus of claim 1, wherein:

when the paper jam is detected in the image forming apparatus, the motor unit first stops a motor of a lower option cassette of the plurality of option cassettes and then stops a motor of an upper option cassette of the plurality of option cassettes after a predetermined period of time.

4. The image forming apparatus of claim 1, wherein:

when reprinting starts starting from paper sheets on transfer paths of the plurality of option cassettes, the motor unit first drives a motor of an upper option cassette of the plurality of option cassettes and then stops a motor of a lower option cassette of the plurality of option cassettes after a predetermined period of time.

5. The image forming apparatus of claim 1, further comprising a UI unit to provide a paper jam handling mode selection menu used to select either whether to remove both the paper sheets on the transfer path of the image forming apparatus and the transfer path of the plurality of option cassettes or to remove only the paper sheet jammed in the image forming apparatus.

6. The image forming apparatus of claim 5, wherein the UI unit is installed in at least one of the image forming apparatus and a host device connected to the image forming apparatus.

7. The image forming apparatus of claim 1, further comprising a UI unit to display the paper sheet on the transfer path of the plurality of option cassettes as is and to indicate the removal of the paper sheet jammed in the image forming apparatus when the paper sheet jammed in the image forming apparatus has been removed.

8. The image forming apparatus of claim 1, further comprising a UI unit to display information indicating that a paper sheet on which an image is to be printed has been picked up from an option cassette having paper sheets, after paper sheets existing on transfer paths of the plurality of option cassettes starting from the paper sheet on the transfer path of the plurality of option cassettes are completely used.

* * * * *